US006733011B2

(12) United States Patent
Su

(10) Patent No.: US 6,733,011 B2
(45) Date of Patent: May 11, 2004

(54) SUPER BACCARAT CARD GAME

(76) Inventor: Yi Qiang Su, 236 California St., San Gabriel, CA (US) 91776

( * ) Notice: Subject to any disclaimer, the term of this patent is extended or adjusted under 35 U.S.C. 154(b) by 96 days.

(21) Appl. No.: 10/034,927

(22) Filed: Dec. 26, 2001

(65) Prior Publication Data

US 2002/0135130 A1 Sep. 26, 2002

Related U.S. Application Data

(63) Continuation-in-part of application No. 09/661,586, filed on Sep. 14, 2000, now abandoned.

(51) Int. Cl.[7] ..... A63F 1/00
(52) U.S. Cl. ..... 273/292
(58) Field of Search ..... 273/292, 274, 273/309; 463/12

(56) References Cited

U.S. PATENT DOCUMENTS 5,257,810 A * 11/1993 Schorr et al. ..... 273/292
5,362,064 A * 11/1994 Lofink et al. ..... 273/292
5,411,268 A * 5/1995 Nelson et al. ..... 273/292
5,549,300 A * 8/1996 Sardarian ..... 273/292
5,636,843 A * 6/1997 Roberts ..... 273/292
5,806,854 A * 9/1998 Coleman et al. ..... 273/292
6,113,102 A * 9/2000 Marks et al. ..... 273/292
6,135,454 A * 10/2000 Mostashari ..... 273/292

* cited by examiner

*Primary Examiner*—Benjamin H. Layno
(74) *Attorney, Agent, or Firm*—Raymond Y. Chan; David and Raymond Patent Group

(57) ABSTRACT

A method of playing a Super Baccarat card game involves a fixed number of players in one round of game, wherein a Host is selected from the players to play against the rest of the players. The Host and the players invest a Capital and Investments respectively wherein each player selectively invests the respective Investment at a BANKER position or a PLAYER position. Two cards are dealt to the BANKER position and the PLAYER position respectively. By determining and comparing total point values of the BANKER cards and the PLAYER cards, which has a higher total point value wins the round of game. An action player is determined by an action number according to the higher point value, so as to determine which of the player to play against the Host and start to collect or payout the Investment until the Capital is totally paid out.

27 Claims, 7 Drawing Sheets

SUPER BACCARAT CARD GAME

CROSS-REFERENCE OF RELATED APPLICATION

This is a Continuation-In-Part application of a non-provisional application having an application Ser. No. 09/661,586 and a filing date of Sep. 14, 2000 now abandoned.

BACKGROUND OF THE PRESENT INVENTION

1. Field of Invention

The present invention relates to card games for entertainment or casino, and more particularly to a method of playing a Super Baccarat card game using at least one desk of 33 cards and commencing with at least two players, wherein one of the players can be assigned as a title of "Host".

2. Description of Related Arts

Numerous card games have existed where players are dealt a number of cards and then have an option of receiving additional cards. The object of such a game is to score a predetermined number of points without going over this predetermined number. A well-known game where the object is to reach a point value of nine without going over this limit is "Baccarat".

Traditionally Baccarat card game which generally can be played in a casino-type environment is involved at least one player and a dealer wherein the players are respectively playing against the dealer. Each player invests a desired amount of money in either "Banker" or "Player" of two parties in order to start a particular round of games. In each single game of each round, two cards are dealt to the "Banker" and the "Player" respectively for comparing the total numerical values of the cards therebetween. An additional card may be dealt depending on the total numerical value of two cards of the "Player" and the "Banker" respectively. For example, when the total numerical value of two cards is less than 6, the "Player" must draw the additional card. By comparing the total numerical value of the "Banker" and the "player", the party having a bigger total numerical value will be the winning party. So, the player who invested the amounted of money in the winning party will be paid even money from the dealer.

However, in the whole process of the traditional Baccarat card game, none of the players can be assigned as a Host, which may reduce an entertainment environment for the players. Even though the Baccarat is easy to play, all the players in the playing group are not correlated.

SUMMARY OF THE PRESENT INVENTION

A main object of the present invention is to provide a method of playing a Super Baccarat card game which is easy to play, full of fun and excited. Accordingly, the Super Baccarat card game of the present invention is operated between at least two to a plurality of players, such as a game between an assigned "Host" and several players or just simply between two players.

The method of Super Baccarat card game is basically an improved Baccarat card game using at least a deck of 36 cards, such as a poker deck. Each deck of cards includes four sets of cards and each set of cards includes an Ace and five (or six) numerical value cards having a sequence of numerical values from 2 to 6 (or 7). The point value of each numerical value card is counted as its face numerical value, for example, the Ace is recognized or counted as one point.

In this game, one of the players is assigned to be a "Host" in turn and the rest of the players are playing against the Host. Each player excluding the Host invests a predetermined amount of money as "Investment" in either "Banker" or "Player" and the Host also invests a predetermined amount of money as "Capital". In each single game of each round, the "Banker" and the "Player" will initially receive three cards respectively as basic information of the opportunity to win the game. Finally, a comparison point value is achieved by each of the "Banker" and the "Player" by summing up the point values of their playing cards. If the point values of each of the "Banker" and the "Player" are larger than ten, a last digit number is taken to achieve the comparison point value. For example, when the "Banker" has three playing cards, which are 2, 4, and 7, the point values of the "Banker" are 13. Therefore, the comparison point value for the "Banker" is 3. Then by comparing the comparison point values between the "Banker" and the "Player", the party with a higher comparison point value counts wins.

If the "Banker" and the "Player" have the same comparison point values, i.e. called Tie Hand, the Host and the players have nothing to lose and a new round of the game will be restarted.

Another object of the present invention is to provide a method of playing a Super Baccarat card game which can use up to 8 decks of playing cards and each deck of playing cards contains seven numerical value cards. Therefore, each player will have a higher opportunity to get the highest comparison point which is 9.

Another object of the present invention is to provide a method of playing a Super Baccarat card game wherein all the players in the playing game are correlated. Each player has a chance to be assigned as the Host which is playing against the rest of the players. Thus, the higher comparison point of each round of the game is assigned as an action number to determine who is the first action player to play against the Host, which is counted from the Host clockwise. In other words, the first action player will be determined at the end of each round of the game.

Moreover, in every single round of game, the players play against the Host which is one of the players. Therefore, each player can be assigned as the Host in order to challenge the rest of the players but not the dealer. So, if the player loses his or her money to other players, he or she is able to win his or her money back from these players later.

Also, the "Capital" from the Host will be divided into certain portions to fit the "Investments" of the players. If the "Capital" is exhausted in the payout starting from the first action player, the rest players will not neither gain nor lose their money even though they have loss the round of game.

Alternatively, the Super Baccarat card game can also be used at least of 52 cards, such as a poker deck. Each deck of cards includes four sets of cards and each set of cards includes an Ace, nine numerical value cards having a sequence of numerical values from 2 to 10, and three face cards including a Jack, a Queen, and a King. The point value of each numerical value card is counted as its face numerical value, for example, the Ace is recognized or counted as one point. The Jack, Queen, or King is respectively and individually counted as ten points.

In each single game of each round, the "Banker" and the "Player" will initially receive two cards respectively to determine the comparison point value. The object of the comparison point value is to score a point value of twenty-one without going over this limit. The higher comparison point of each round of the game is assigned as an action number to determine who is the first action player to play against the Host, which is counted from the Host clockwise.

Accordingly, in order to accomplish the above objects, the present invention provides a method of playing a Super Baccarat card game which comprises the steps of:

(a) providing at least two players for the card game;

(b) providing a BANKER box and a PLAYER box for each of the players;

(c) providing at least a deck of cards;

(d) selecting a Host from the players;

(e) investing a Capital by the Host and an Investment by each of the players other than the Host at the respective BANKER box or PLAYER box;

(f) shuffling the deck of cards;

(g) dealing at least two cards of the deck of cards to a BANKER position serving as BANKER cards and dealing at least two cards of the deck of cards to a PLAYER position serving as PLAYER cards respectively;

(h) determining total values of the BANKER cards and the PLAYER cards respectively by summing up points of each of the BANKER cards and the PLAYER cards respectively to form a total sum of points;

(i) determining a comparison point value for each of the BANKER cards and the PLAYER cards based on the total point values of the BANKER cards and the PLAYER cards;

(j) comparing the comparison point values of the BANKER cards at the BANKER position and the PLAYER cards at the PLAYER position, wherein whichever the BANKER cards or the PLAYER cards has a higher comparison point wins the round of game;

(k) determining which of the players is a first action player to play against the Host by determining an action number, which is the higher comparison point value of the two comparison point values of the BANKER cards and the PLAYER cards, and determining the first action player by counting the action number among the players starting at the Host;

(l) determining whether each of the players win against the Host in the round of game, starting from the action player, by checking whether the players invested in the BANKER boxes or PLAYER boxes in front of the players, wherein when the BANKER cards at the BANKER position win the round of game over the PLAYER cards at the PLAYER position, each of the players who invested in the respective BANKER box wins against the Host in the round of game, wherein when the PLAYER cards at the PLAYER position win the round of game over the BANKER cards at the BANKER position, each of the players who invested in the respective PLAYER box wins against the Host in the round of game;

(m) starting from the first action player, collecting the Investment of each of the players who loses against the Host in the round of game; and (n) starting from the first action player, paying to each of the players who wins against the Host in the round of game until the Capital is totally paid out.

DETAILED DESCRIPTION OF THE PREFERRED EMBODIMENT

Figure 1A:
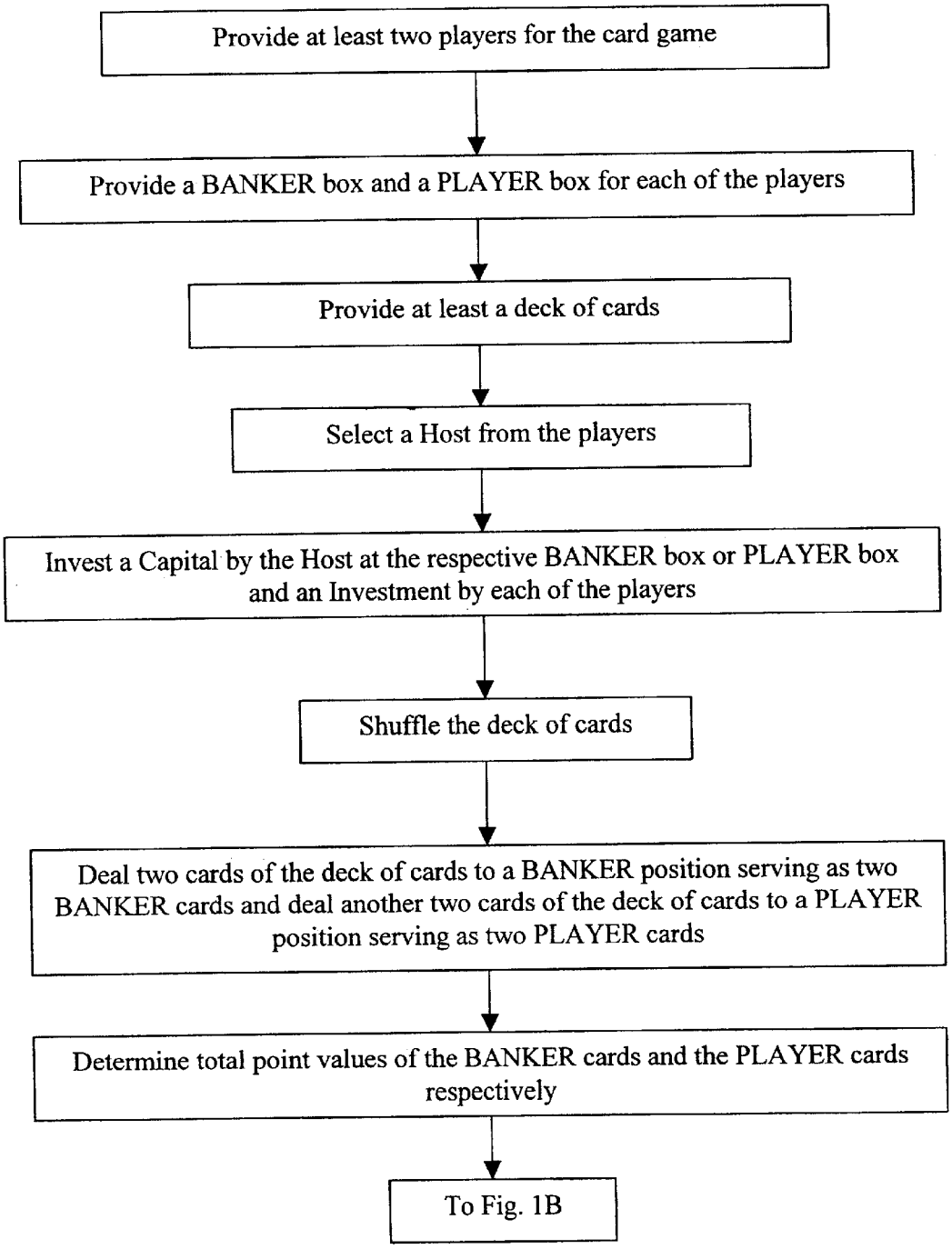
FIG. 1 is a block diagram illustrating a method of playing a Super Baccarat card game according to a first preferred embodiment of the present invention.
Figure 1B:
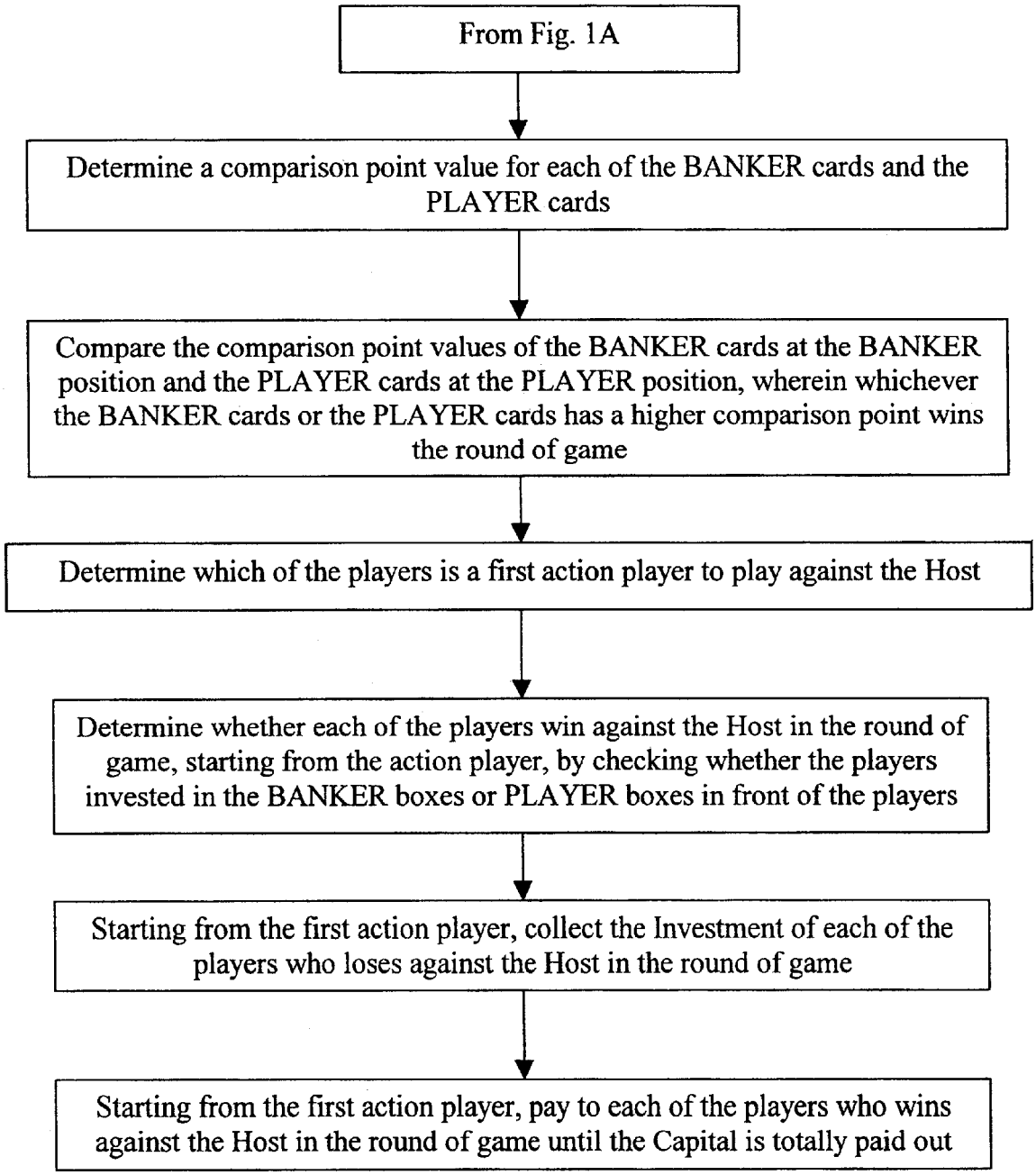
Figure 2:
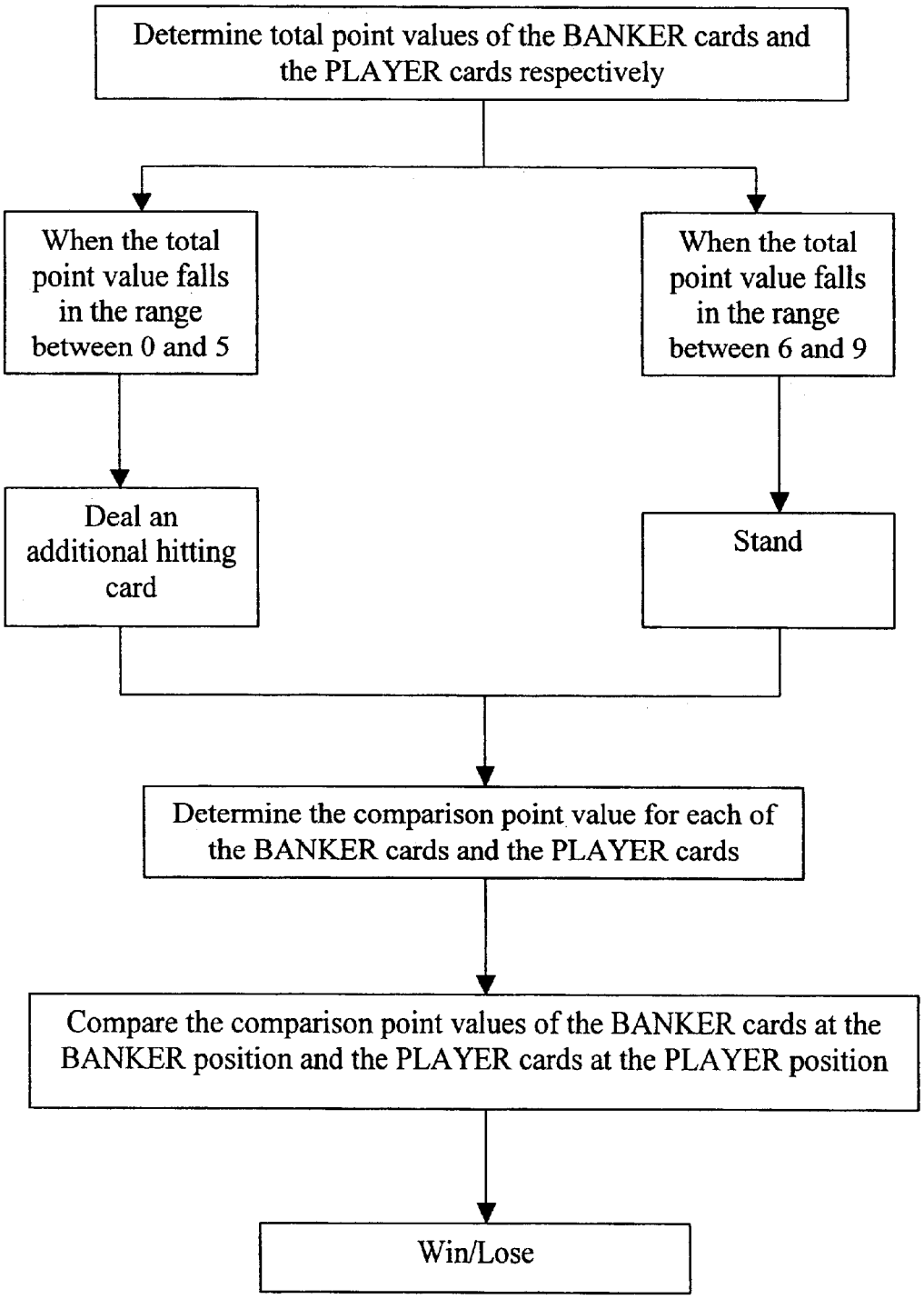
FIG. 2 is a flow chart of the method of playing the Super Baccarat card game according to the above first preferred embodiment of the present invention.

Referring to FIGS. 1 and 2 of the drawings, a Super Baccarat card game according to a first preferred embodiment of the present invention is illustrated. The Super Baccarat card game for entertainment or casino is operated between a group of players having at least players. The method of Super Baccarat card game is basically an improved Baccarat card game using at least one deck of cards, such as a poker deck.

The method of playing the Super Baccarat card game comprises the steps of:

(1) Provide at least two players for the card game.

(2) Provide a BANKER box and a PLAYER box for each of the players.

(3) Provide at least a deck of cards.

(4) Select a Host from the players.

(5) Invest a Capital by the Host and an Investment by each of the players other than the Host at the respective BANKER box or PLAYER box.

(6) Shuffle the deck of cards.

(7) Deal at least two cards of the deck of cards to a BANKER position serving as BANKER cards and deal at least two cards of the deck of cards to a PLAYER position serving as PLAYER cards respectively.

(8) Determine total point values of the BANKER cards and the PLAYER cards respectively by summing up points of each of the two BANKER cards and the two PLAYER cards respectively to form a total sum of points.

(9) Determine a comparison point value for each of the BANKER cards and the PLAYER cards based on the total point values of the BANKER cards and the PLAYER cards.

(10) Compare the comparison point values of the BANKER cards at the BANKER position and the PLAYER cards at the PLAYER position, wherein whichever the BANKER cards or the PLAYER cards has a higher comparison point wins the round of game.

(11) Determine which of the players is a first action player to play against the Host by (11.1) determining an action number, which is the higher comparison point value of the two comparison point values of the BANKER cards and the PLAYER cards, and (11.2) determining the first action player by counting the action number among the players starting at the Host.

(12) Determine whether each of the players win against the Host in the round of game, starting from the action player, by checking whether the players invested in the BANKER boxes or PLAYER boxes in front of the players, wherein when the BANKER cards at the BANKER position win the round of game over the PLAYER cards at the PLAYER position, each of the players who invested in the respective BANKER box wins against the Host in the round of game, wherein when the PLAYER cards at the PLAYER position win the round of game over the BANKER cards at the BANKER position, each of the players who invested in the respective PLAYER box wins against the Host in the round of game.

(13) Starting from the first action player, collect the Investment of each of the players who loses against the Host in the round of game.

(14) Starting from the first action player, pay to each of the players who wins against the Host in the round of game until the Capital is totally paid out.

According to the first preferred embodiment, a deck of 36 cards is used wherein 5 to 8 decks of cards is preferred to be used in the Super Baccarat card game. Each deck of cards includes four sets of face cards and four sets of numerical value cards. Each set of the face cards includes an Ace, a Jack card, a Queen card, and a King card and each of said numerical value cards includes a 2 card, a 3 card, a 4 card, a 5 card, and a 6 card. A numerical value of each of the numerical value cards counting as a point value thereof, the Ace card counting as a point value "1", the Jack card, the Queen card, and the King card respectively counting as a value of "10".

The four sets of numerical value cards and the four sets of face cards of each deck can also be identified by different face signs to include a SPADE group set, a HEART group set, a CLUB group set, and a DIAMOND group set or other kinds of signs.

In other words, the point value of each numerical value card is counted as its face numerical value, for example a 6 SPADE card and a 6 DIAMOND card representing a point value of "6", a 4 CLUB card and a 4 HEART card representing a point value of "4", a 2 SPADE card and a 2 CLUB card representing a point value of "2". In addition, the Ace is recognized or counted as one point.

Figure 3:
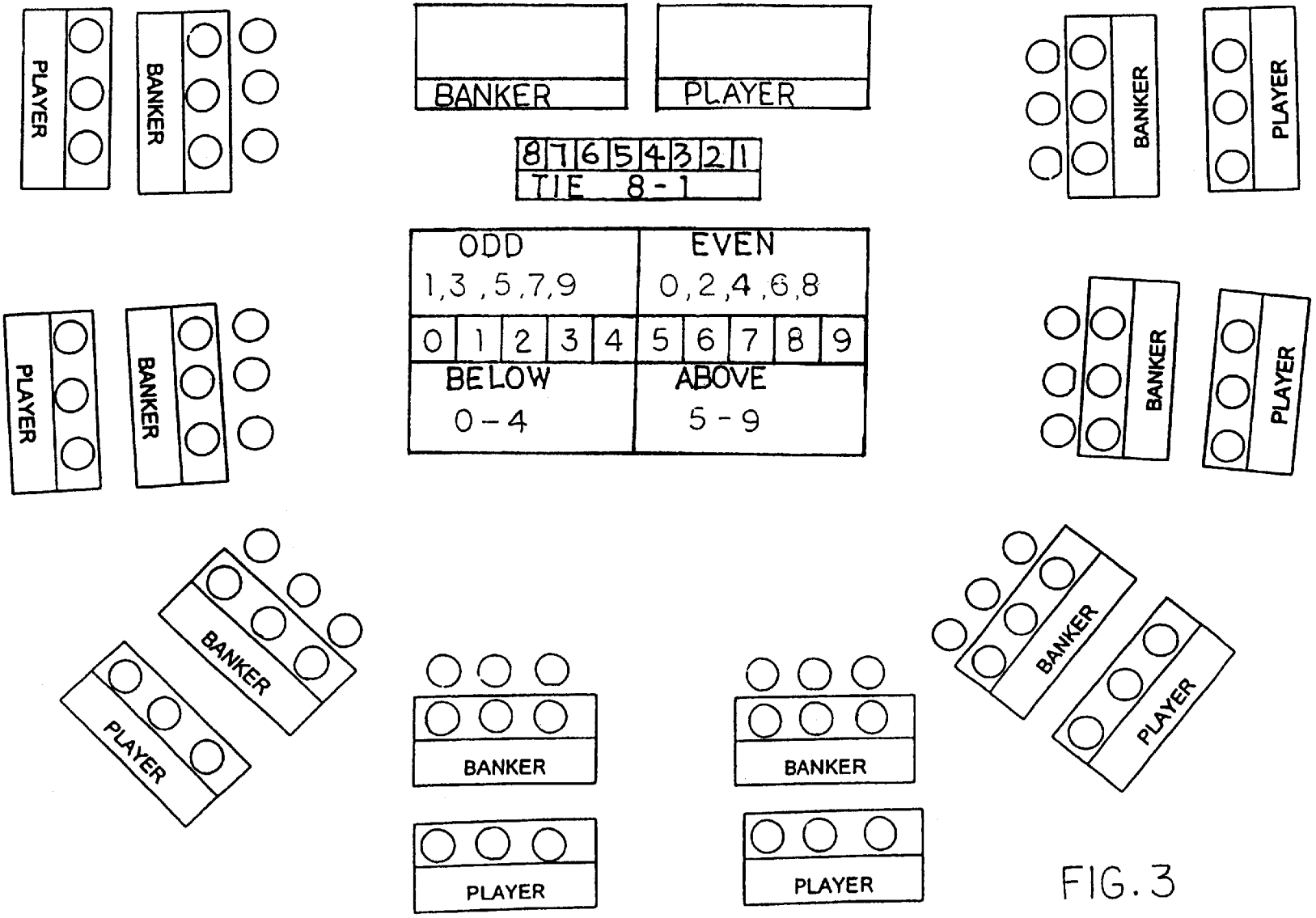
FIG. 3 is a top view of a game table for playing the Super Baccarat card game according to the above first preferred embodiment of the present invention.

As shown in FIG. 3, a game table according to the preferred embodiment of the present invention is illustrates, wherein the game table provides a betting surface to play the Super Baccarat card game thereon. There are eight playing positions provided on the betting surface of the game table for maximum eight players P1 to P8 playing the Super Baccarat card game. Other players, excluding the eight players, can watch the live card game and may participate with side bets. The game table further has a dealer position for a dealer D serving and dealing the cards. Of course, the game table preferably has designated regions clearly marked on the betting surface thereof, so as to prevent any confusion for the players. However, any kind of table can be used for playing the Super Baccarat card game with the same concept thereof.

To start the Super Baccarat card game, one of the players is assigned to be the Host in step (4). Each player can be assigned as the Host in two continuous rounds of game. The Host will be shifted to a neighboring player clockwise for another two continuous rounds of game. When one of the players is assigned to be the Host, the rest of the players will play against the Host. In other words, the Host is selectively assigned from the players for two continuous rounds of game and then another one of the players must be selected as the Host for next two continuous rounds of game.

In step (5), at the beginning of each round of game, each player excluding the Host invests a predetermined amount of money as the "Investment" in either the Banker box or the Player Box provided in front of each player and the Host invests a predetermined amount of money as the "Capital", wherein the Investment from each player does not have to be the same amount of money and the total sun of the Investment can be more or lesser than the Capital from the Host. However, the Investment and the Capital can be money in casino or even candy when playing for fun only.

In steps (6) and (7), the dealer D if necessary, shuffles the deck or decks of 36 cards and deals three cards to the BANKER position serving as three BANKER cards and the another three cards to the PLAYER position serving as three PLAYER cards in face up manner. The three BANKER cards and the three PLAYER cards can be dealt at a time to the BANKER position and the PLAYER position or one at a time to each position until both the BANKER position and the PLAYER position receive two cards.

In step (8), all the players including the Host carefully check the BANKER cards at the BANKER position and the PLAYER cards at the PLAYER position in order to determine the total sum of points of the BANKER cards at the BANKER position and the PLAYER cards at the PLAYER position. The total sum of points is counted as the total point value when the total sum of points is less than or equal to nine. A last digit of the total sum of points is counted as the total point value when the total sum of points is more than nine.

EXAMPLE A

If the BANKER position received three BANKER cards of 3 DIAMOND, 2 HEART, and 4 CLUB, the total sum of points of the BANKER cards is "9".

EXAMPLE B

If the PLAYER position received three PLAYER cards of 6 CLUB, 5 DIAMOND, and JACK SPADE, the total sum of points of the three PLAYER cards as the following values: 6+5+10=21, the total sum of points of the PLAYER cards is the last digit of 21 which is "1".

EXAMPLE C

If the BANKER position received three BANKER cards of ACE HEART, 2 HEART, and 4 HEART, the total sum of point of the two BANKER cards is "7".

In step (9), the comparison point values for the BANKER cards and the PLAYER cards are the total point values of the BANKER cards and the PLAYER cards respectively.

It is worth to mention that since the deck of the cards only includes the Ace and the numerical value cards from 2 to 6, and the pointless cards of the JACK card, QUEEN card, and KING card, the total point values of the BANKER cards and the PLAYER cards will have a higher opportunity to get the highest comparison point "9". In other words, the deck of cards does not include any higher value card such as the numerical value card of 7 card, 8 card, 9 card, and 10 card, so that each of the BANKER cards and the PLAYER cards has a greater chance to a higher comparison point value.

So, when the BANKER position wins the round of game, the player who invests the Investment in the BANKER position wins the round of game as well. On the other hand, the player who invests the Investment in the PLAYER position loses the round of game.

Thus, when the comparison point value of the BANKER cards is the same as that of the PLAYER cards, the round of game is tie. So, both the players and the Host neither win nor loss the round game and the Investment and the Capital will be fully returned to the respective players and Host.

The Super Baccarat card game further provides a TIE box wherein each of the players other than the Host is able to invest the Investment at the TIE box in such a manner that each of the players who invested in the TIE box wins against the Host in the round of game when the round of game is tie. A betting ratio of the TIE box should be 1 to 2 or more.

For further modification of the card game, the deck of 41 cards can be used wherein each deck of cards includes a set of face cards including an Ace card, a Jack card, a Queen card, a King card, a set of numerical value cards including a 2 card, a 3 card, a 4 card, a 5 card, 6 card, and a 7 card, and at least a Joker card.

The Joker card acts as a wild card wherein the Joker card selectively represents a point value from 0 to 9 in such a manner that when a hand of each of the BANKER cards and the PLAYER cards consists of one of the Joker cards, the total point value of the hand of the BANKER cards or the PLAYER cards automatically counts as natural comparison point value "9" which is greater than the natural comparison point value "9" without the joker card. Moreover, when both the BANKER cards and the PLAYER cards have the Joker cards, which has the highest ranking of the card game automatically wins the round of game without further judgment.

EXAMPLE (I)

Banker Cards: 1 Club, 6 Spade, and a Joker

Vs.

Player Cards: 4 Spade, JACK Heart, and 5 Club

Both the Banker cards and the Player cards have the total point value of natural "9". However, the Banker cards have a Joker card and the Player cards have no Joker card so that the Banker position wins the round of game.

Alternatively, the deck of cards can further include another Joker card. In other words, the deck of cards includes 42 cards, the ranking of the cards is shown as follow.

EXAMPLE (II)

Banker Cards: 2 Spade, 3 Spade, and 4 Spade

Vs.

Player Cards: Two Joker Cards

Since the Player cards have two Joker cards, which is the highest ranking of the game, the Player position automatically wins the round of game even though the Banker cards have the total point value of "9".

EXAMPLE (III)

Banker Cards: 6 Club, 3, Heart, and a Joker

Vs.

Player Cards: 2 Club, JACK Diamond, and a Joker

Both Banker cards and Player cards have the Joker card and the total point value of "9". However, in such situation, the Joker cards in both Banker cards and Player cards will be cancelled such that the total point value of the BANKER cards and PLAYER cards will be counted by the rest of the numerical card. In this example, the total point value of the Banker cards is "9" and the total point value of the Player cards is "2". Therefore, the BANKER position wins the round of game.

Alternatively, the Joker card can selectively represent a point value either 1 or 7 in such a manner that when each of the BANKER cards and the PLAYER cards consists of one of the Joker cards, the total point value of each of the BANKER cards and the PLAYER cards can be determined by summing up another BANKER/PLAYER card with 1 or 7.

EXAMPLE (IV)

Banker Cards: 6 Club, 7 Club, and Ace Heart

Vs.

Player Cards: 2 Club, KINK Spade, and a Joker

The total point value of the BANKER cards is 4 and the total point value of the PLAYER cards is either 3 or 9. When the Joker card is selected to have a point value "1", the total point value of the PLAYER cards is 3 such that the PLAYER position will lose the round of game. However, if the Joker card is selected to have a point value "7", the total point value of the PLAYER cards is 9 so that the PLAYER position wins the round of game. Therefore, by smartly selecting the point value of the Joker card, an optimum total point value of each of the BANKER cards and the PLAYER cards will be achieved.

After declaring which position wins the round of game, the action number is determined according to the higher comparison point value in step (10). For example, when the comparison point value for the BANKER cards is "8" and the comparison point value for the PLAYER cards is "6", the BANKER position wins the round of game. Therefore, the action number is determined as "8".

The action number is used to determine which of the players is the first action player to play against the Host wherein the first action player is determined by counting the action number among the players starting at the Host preferably in a clockwise direction. Then the Host will start to collect or pay the same amount of Investment to each of the players starting from the first action player clockwise. It is worth to mention that a same amount of the Investment of each of the players who wins against the Host in the round of game is paid by the Host from the Capital until the Capital is totally paid out.

Figure 4:
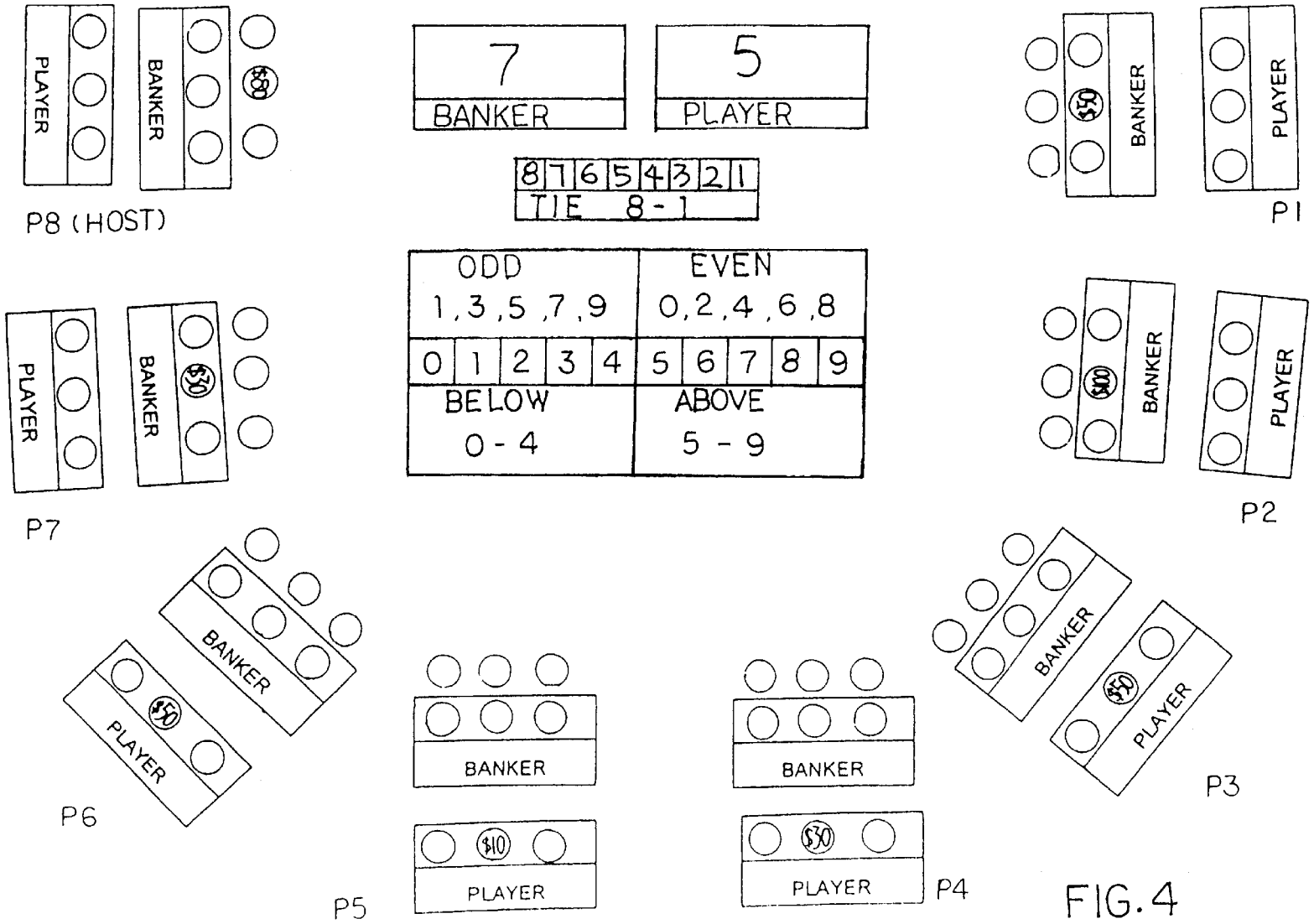
FIG. 4 illustrates an example of playing the Super Baccarat card game according to the above first preferred embodiment of the present invention.

For example, as shown in FIG. 4, a sample of a final stage of the Super Baccarat card game is illustrated, wherein the comparison point value for the BANKER cards is "7" and the comparison point value for the PLAYER cards is "5", the Investment from each of the players and the Capital from the Host are respectively indicated. According to the order of the players sitting on the game table, the player P8 sitting on the eighth position is assigned as the Host, and the action number of the round of game is "7" which is the higher comparison point value of the BANKER cards. The first action player is counted by the seventh player starting from the Host clockwise, which is the player P6 who sitting on the sixth position. As the result, the sixth player P6 will play against the Host first.

As shown in FIG. 4, the first action player has invested $50 in the PLAYER position and has lost the round of game, the Host will collect the Investment from the first action player first. At this time, the Capital of the Host becomes $130 from initially $80. The next action player plays against the Host is the player P7 who sitting on the seventh position and invests $30 in the BANKER position that wins the round of game. So, the player P7 will collect the same amount of Investment from the Capital from the Host which is deducted $30 from $130. Accordingly, after the Host plays against the player P1 who sitting on the first position, the Capital from the Host is reduced to $50. Since the player P2 wins the round of game with $100 of Investment which is more than the Capital from the Host, the player P2 can only collect the whole Capital which is $50 from the Host. Thus, the players who sitting on the third, fourth, and fifth positions respectively will not play against the Host no matter they win or lose the round of game since the Capital from the Host is totally paid out.

It is worth to mention that the maximum total Investments from the players that the Host can win is the double of the Capital from the Host invested such that if the Host invests $100 as the Capital, the Host can only win up to $100 from the total Investments from the players, so as to have a fair game to each player.

The following rules are preferred to regulate the Super Baccarat card game of the present invention.

(1) No new player is admitted to join the game once a round of game is started.

(2) Cards cannot be touched by each of the players, including the Host, in a whole process of the round of game except the person who shuffles and deals the cards.

(3) Each player has the right to refuse to be assigned as the Host and can only pass the Host to the neighboring player in a clockwise direction.

In order to enhance the excitement of the present invention, the Super Baccarat card game further provides a side bet option in step (2). Accordingly, the Super Baccarat card further provides a plurality of side bet boxes which are an ODD box, an EVEN box, an ABOVE box, a BELOW box, and a plurality of point value boxes on the betting surface of the game table, as shown in FIG. 3.

The ODD box contains the point values of 1, 3, 5, 7, and 9 and the EVEN box contains the point values of 0, 2, 4, 6, and 8. The BELOW box contains the point values from 0 to 4 and the ABOVE box contains the point values from 5 to 9. The point value boxes contain the point values from 1 to 9 respectively.

Each of the players excluding the Host is able to invest a predetermined amount of money as a "Side Bet Investment" in the side bet table in such a manner that when the higher comparison point value in the round of game matches one of the point values in the side bet table, the player who invested in the respective side bet box wins against the Host.

For example, when the higher comparison point value in the round of game is "7", each of the players who invested in either the ODD box, the ABOVE box, or the point value box of 7 wins against the Host in the round of game. On the other hand, each of the players who invested in either the EVEN box, the BELOW box, or the point value boxes of 0 to 6, 8, and 9 respectively loses against the Host. Therefore, starting from the first action player, the Side Bet Investment of each of the players who loses against the Host in the round of game will be collected. Then, starting from the first action player, the Side Bet Investment of each of the players who wins against the Host in the round of game will be paid until the Capital is totally paid out.

It is worth to mention that each of the players excluding the Host must invest the Investment at the BANKER box or the PLAYER box before investing the Side Bet Investment at the side bet boxes. In other words, each of the players cannot invest the Side Bet Investment at the side bet boxes only. However, in some circumstance such as in casino, other players, including the eight players on the game table, allow to play the side bet boxes without investing the Investment at the BANKER box or the PLAYER box. The betting ratio of each of the side bet boxes may be different due to the probability thereof. For example, the betting ratios of the ODD box, the EVEN box, the ABOVE box, and the BELOW box may be 1 to 1, and the betting ratio of each of the point value boxes may be 1 to 5 or more.

Figure 5:
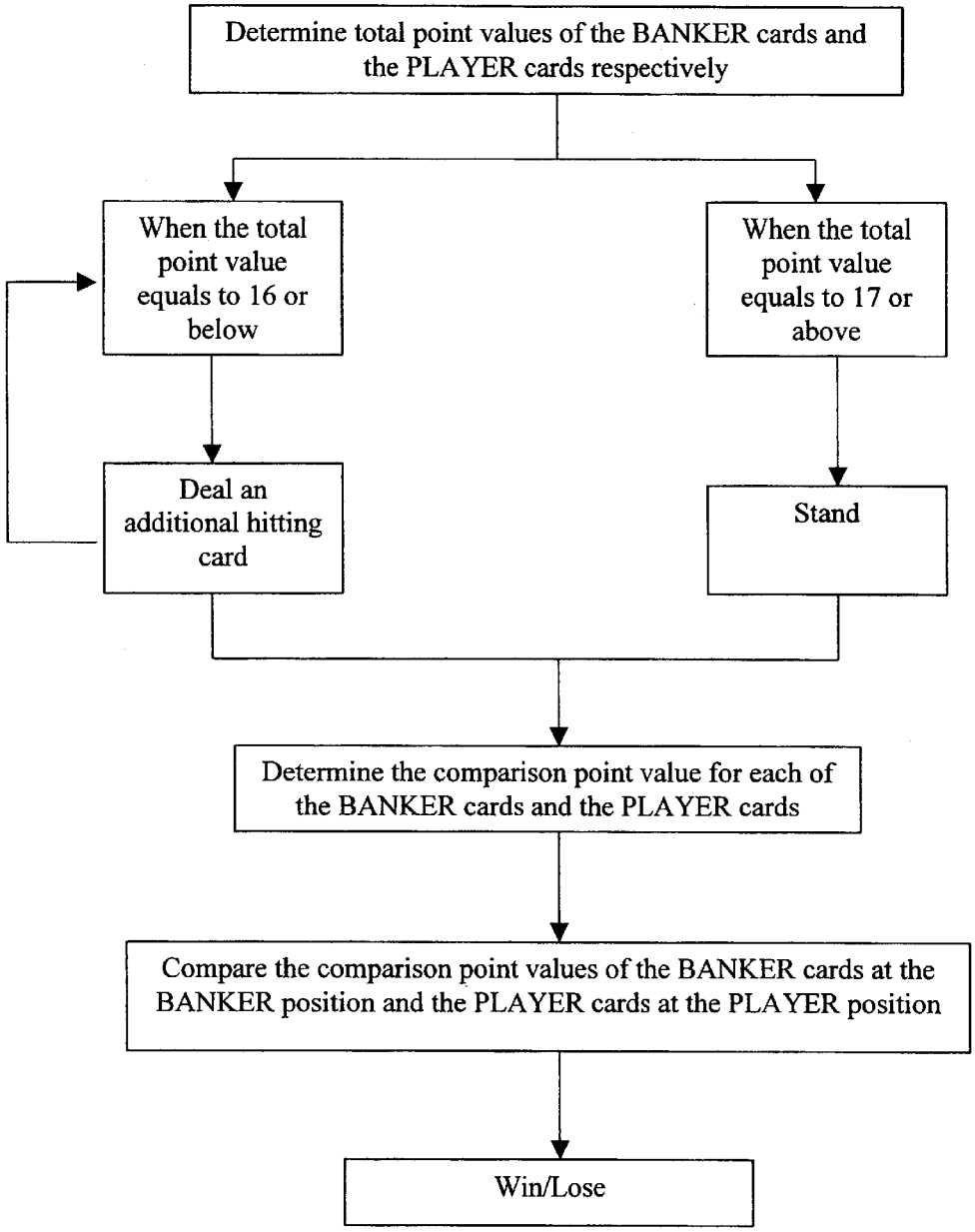
FIG. 5 is a flow chart of a method of playing a Super Baccarat card game according to a second preferred embodiment of the present invention.

Referring to FIG. 5, a second embodiment of the Super Baccarat card game illustrates an alternative mode of the present invention wherein at least a deck of 52 cards is used to achieve the comparison point value of twenty-one without going over this limit.

Each deck of cards includes four set of cards and each set cards includes an ACE, three face cards including a JACK, a QUEEN, and a KING, and nine numerical value cards having a sequence of numerical values from 2 to 10, i.e. 2, 3, 4, 5, 6, 7, 8, 9, and 10. The four sets of face value and numerical value cards of each deck can also be identified by different face signs to include a SPADE group set, a HEART group set, a CLUB group set, and a DIAMOND group set or other four kinds of sign.

All the numbers on the numerical value cards represent their point value, for example a 7 SPADE card and a 7 DIAMOND card representing a point value of "7", a 10 CLUB card and a 10 HEART card representing a point value of "10", a 2 SPADE card and a 2 CLUB card representing a point value of "2". In addition, the face value card ACE represents a point value "1"or "11". The face value cards of JACK, QUEEN, and KING respectively represent a point value of "10".

In step (8), all the players including the Host carefully check the two BANKER cards at the BANKER position and the two PLAYER cards at the PLAYER position in order to determine the total sum of points of the BANKER cards at the BANKER position and the PLAYER cards at the PLAYER position. The total sum of points is counted as the total point value when the total sum of points is less than or equal to twenty-one.

EXAMPLE D

If the BANKER position received two BANKER cards of 3 DIAMOND and 5 HEART, the total sum of points of the BANKER cards is "8".

EXAMPLE E

If the PLAYER position received two PLAYER cards of 7 CLUB and 6 SPADE, the total sum of points of the two PLAYER cards is "13".

EXAMPLE F

If the BANKER position received two BANKER cards of ACE HEART and 4 HEART, the total sum of point of the two BANKER cards is either "4" or "15".

EXAMPLE G

If the PLAYER position received two host cards of KING SPADE and JACK HEART, the sum of the point values of the PLAYER cards is "20".

EXAMPLE H

If the BANKER position received two host cards of QUEEN DIAMOND and ACE CLUB, the sum of the point values of the two host cards is "21" which is called "BLACK JACK".

Furthermore, an additional hitting card is dealt to the BNAKER position and/or PLAYER position under the pre-established guiding rule which is set forth in Table 1 below. If there is no additional hitting card dealt to neither the BANKER position nor the PLAYER position, determine the comparison point vale for each of the BANKER cards and the PLAYER cards based on the total point values of the BANKER cards and the PLAYER cards.

TABLE 1

| Total sum of points of BANKER cards and PLAYER cards | |
|---|---|
| 16 or below | Draws |
| 17 or above | Stands |

Some typical examples are illustrated as follows according to the guiding rule:

(i) When the total point value of the BANKER cards is "13" and the total point value of the PLAYER cards is "14", both the BANKER position and the PLAYER position must be drawn the additional hitting card.

(ii) When the total point value of the BANKER cards is "17" and the total point value of the PLAYER cards is "16", the BANKER position must be stood which will not receive any additional hitting card and the PLAYER position must be drawn one additional hitting card.

(iii) When the total point value of the BANKER cards is "13" and the total point value of the PLAYER cards is "19", the BANKER position must be drawn one additional hitting card and the PLAYER position must be stood which will not receive any additional hitting card.

(iv) When the total point value of the BANKER cards is "18" and the total point value of the PLAYER cards is "18", both the BANKER and the PLAYER must be stood which will not receive any additional hitting card. The round of game is a tie game.

(v) When the total point value of the BANKER cards is "21" and the total point value of the PLAYER cards is "20", the BANKER position automatically wins the round of game.

When the total point value of either the BANKER cards or the PLAYER cards equal to 17 or above, the total point value is counted as Natural comparison point value and the BANKER cards or the PLAYER cards wins the round of game and no the additional hitting card is drawn neither the BANKER position nor the PLAYER position.

The following examples illustrate how to determine of the comparison point value for each of the BANKER cards and the PLAYER cards when the hitting cards are dealt thereto respectively.

EXAMPLE 4

When the total point value of the BANKER cards is "9" and a hitting card having a point value of "3" is drawn, the total sum of points of the BANKER cards is "12". Since the total sum of points of the BANKER cards is still under 17, a second hitting card is required to deal to the BANKER position. The second hitting card has a point value of "7" such that the comparison point for the BANKER is "19". The total point value of the PLAYER cards is "8" and a hitting card having a point value of "10" is drawn, the comparison point value for the PLAYER cards is "18". So, the BANKER position wins the round of game.

EXAMPLE 5

When the total point value of the BANKER cards is "13" and a hitting card having a point value of "4" is drawn, the comparison point value for the BANKER cards is "17". The total point value of the PLAYER cards is "15" and drawn a hitting card having a point value of "2" is drawn, the comparison point value for the PLYAER cards is "17". So, it is a tie game.

EXAMPLE 6

When the total point value of the BANKER cards is "18" which must be stood, the comparison point value for the BANKER cards is "18". The total point value of the PLAYER cards is "15" and a hitting card having a point value of "9" is drawn, the comparison point value for the PLAYER cards is "24" which is over the limit. So, the BANKER position wins the round of game.

So, when the BANKER position wins the round of game, the player who invests the Investment in the BANKER position wins the round of game as well. On the other hand, the player who invests the Investment in the PLAYER position loses the round of game.

Thus, when the comparison point value of the BANKER cards is the same as that of the PLAYER cards, the round of game is tie. So, both the players and the Host neither win nor loss the round game and the Investment and the Capital will be fully returned to the respective players and Host.

The Super Baccarat card game further provides a TIE box wherein each of the players other than the Host is able to invest the Investment at the TIE box in such a manner that each of the players who invested in the TIE box wins against the Host in the round of game when the round of game is tie. A betting ratio of the TIE box should be 1 to 2 or more.

Accordingly, the action number is determined by the higher comparison point value between the BANKER cards and the PLAYER cards wherein when the comparison point value for the BANKER cards is "19" and the comparison point value for the PLAYER cards is "17", the action number is "19". The pay out method of the second embodiment is the same as that of the first embodiment.

Figure 6:
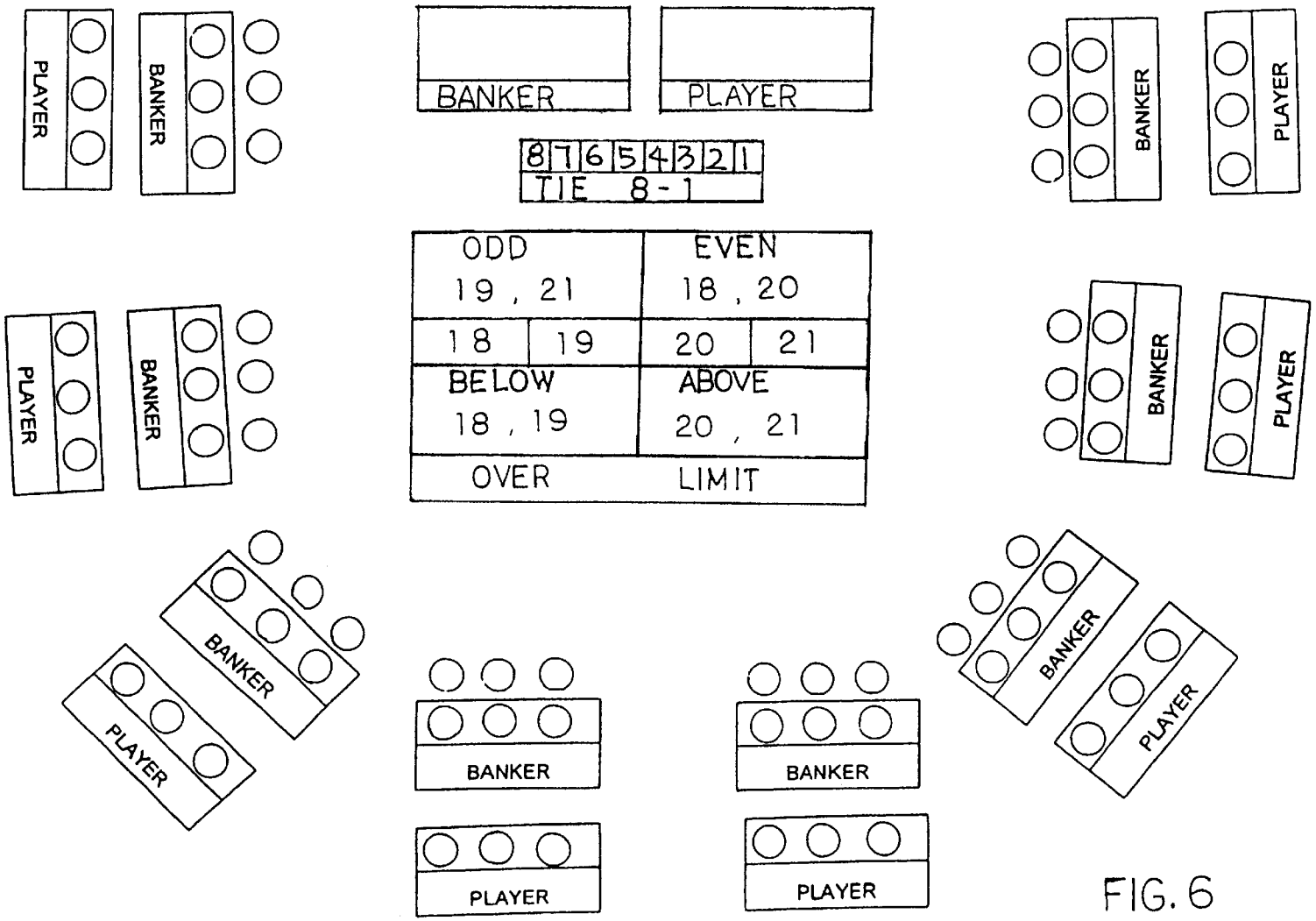
FIG. 6 is a top view of a game table for playing the Super Baccarat card game according to the above second embodiment of the present invention.

According to the second embodiment, the ODD box contains the point values of 19 and 21 and the EVEN box contains the point values of 18 and 20. The ABOVE box contains the point values from 18 to 19 and the BELOW box contains the point values from 20 to 21. The point value boxes contain the point values from 17 to 21 respectively, as shown in FIG. 6.

The side bet boxes further has an OVER LIMIT box wherein one of the players, other than the Host, who invested the Side Bet Investment at the OVER LIMIT box wins against the Host in a condition that both the comparison point values of the BANKER cards and the PLAYER cards are over the limit of 21 in the round of game. The betting ratio of the OVER LIMIT box should be 1 to 3 or more.

Each of the players excluding the Host is able to invest a predetermined amount of money as the "Side Bet Investment" in the side bet table in such a manner that when the higher comparison point value in the round of game matches one of the point values in the side bet table, the player who invested in the respective side bet box wins against the Host.

For example, when the higher comparison point value in the round of game is "20", each of the players who invested in either the ODD box, the ABOVE box, or the point value box of 20 wins against the Host in the round of game. On the other hand, each of the players who invested in either the EVEN box, the BELOW box, or the point value boxes of 17, 18, 19, and 21 loses against the Host. Therefore, starting from the first action player, the Side Bet Investment of each of the players who loses against the Host in the round of game will be collected. Then, starting from the first action player, the Side Bet Investment of each of the players who wins against the Host in the round of game will be paid until the Capital is totally paid out. It is worth to mention that when the higher comparison point value of the round of game is 17, the Investment from the players at the ODD box, the EVEN box, the ABOVE box, and the BELOW box can be totally returned.

Each of the players excluding the Host must invest the Investment at the BANKER box or the PLAYER box before investing the Side Bet Investment at the side bet boxes. In other words, each of the players cannot invest the Side Bet Investment at the side bet boxes only. However, in some circumstance such as in casino, other players, including the eight players on the game table, allow to play the side bet boxes without investing the Investment at the BANKER box or the PLAYER box. The betting ratio of each of the side bet boxes may be different due to the probability thereof. For example, the betting ratios of the ODD box, the EVEN box, the ABOVE box, and the BELOW box may be 1 to 1, and the betting ratio of each of the point value boxes may be 1 to 4 or more.

What is claimed is:

1. A method of playing a Super Baccarat card game, comprising the steps of:

(a) providing at least two players for said card game;

(b) providing a BANKER box, a PLAYER box, and a TIE box for each of said players;

(c) providing at least a deck of cards;

(d) selecting a Host from said players;

(e) investing a Capital by said Host and an Investment by each of said players other than said Host at said respective BANKER box, PLAYER box, or TIE box;

(f) shuffling said deck of cards;

(g) dealing at least two cards of said deck of cards to a BANKER position serving as BANKER cards and dealing at least two cards of said deck of cards to a PLAYER position serving as PLAYER cards respectively;

(h) determining total values of said BANKER cards and said PLAYER cards respectively by summing up points of each of said two BANKER cards and said two PLAYER cards respectively to form a total sum of points;

(i) determining a comparison point value for each of said BANKER cards and said PLAYER cards based on said total point values of said BANKER cards and said PLAYER cards;

(j) comparing said comparison point values of said BANKER cards at said BANKER position and said PLAYER cards at said PLAYER position, wherein whichever said BANKER cards or said PLAYER cards has a higher comparison point wins said round of game, wherein when said comparison point value of said BANKER cards equals to said comparison point value of said PLAYER cards, said round of game is tie;

(k) determining which of said players is a first action player to play against said Host by (k.1) determining an action number, which is said higher comparison point value of said two comparison point values of said BANKER cards and said PLAYER cards, and (k.2) determining said first action player by counting said action number among said players starting at said Host;

(l) determining whether each of said players wins against said Host in said round of game, starting from said action player, by checking whether said players invested in said BANKER boxes, PLAYER boxes, or TIE boxes in front of said players, wherein when said BANKER cards at said BANKER position win said round of game over said PLAYER cards at said PLAYER position, each of said players who invested in said respective BANKER box wins against said Host in said round of game, wherein when said PLAYER cards at said PLAYER position win said round of game over said BANKER cards at said BANKER position, each of said players who invested in said respective PLAYER box wins against said Host in said round of game, wherein when said PLAYER cards at said PLAYER position tie said round of game with said BANKER cards at said BANKER position, each of said players who invested in said respective TIE box wins against said Host in said round of game;

(m) starting from said first action player, collecting said Investment of each of said players who loses against said Host in said round of game; and (n) starting from said first action player, paying to each of said players who wins against said Host in said round of game until said Capital is totally paid out, wherein when said Capital, starting from said first action player, is totally paid out for some of said players who win against said Host in said round of game, the rest of said players who win against said Host in said round of game are neither gain nor lose said investments thereof even though the rest of said players have lost said round of game.

2. The method, as recited in claim 1, wherein, in the step (p), a same amount of said Investment of each of said players who wins against said Host in said round of game is paid by said Host from said Capital until said Capital is totally paid out.

3. The method, as recited in claim 2, in step (e), further providing a Side Bet boxes including an ODD box, an EVEN box, an ABOVE box, a BELOW box, and a plurality of POINT VALUE boxes, said ODD box representing point value of "1", "3", "5", "7", and "9", said EVEN box representing point values of "0", "2", "4", "6", and "8", said BELOW box representing point values of "0", "1", "2", "3", and "4", said ABOVE box representing point values of "5", "6", "7", "8", and "9", and said POINT VALUE boxes representing point values of "5", "6", "7", "8", and "9" respectively in such a manner that the step (l) further comprises a step of determining whether each of said players wins against said Host in said round of game, starting from said action player, by checking whether said players invested in said respective Side Bet boxes, wherein when said higher comparison point value of said round of game matches said point value in said respective Side Bet box in said round of game, each of said players who invested in said respective Side Bet box wins said round of game over said Host.

4. The method, as recited in claim 3, wherein each of said players excluding said Host must invest said Investment at said BANKER box, PLAYER box, or TIE box before investing on said Side Bet boxes.

5. The method, as recited in claim 3, wherein, in step (g), three cards of said deck are dealt to said BANKER position and another three cards of said deck are dealt to said PLAYER position, wherein said comparison value for each of said BANKER cards and said PLAYER cards is counted as a last digit of said total sum of points of each of said BANKER cards and PLAYER cards when said total sum of points is more than nine.

6. The method, as recited in claim 5, wherein said deck of cards includes 36 cards, and wherein each deck of cards includes four sets of face value cards and four set of numerical value cards, wherein each set of said face cards includes an Ace card, a Jack card, a Queen card, and a King card, and each set of numerical value cards includes a 2 card, a 3 card, a 4 card, a 5 card, and a 6 card, a numerical value of each said numerical value cards counting as a point value thereof, said Ace card counting as a point value of "1", and a numerical value of said Jack card, Queen card, and King card counting as a point value of "0".

7. The method, as recited in claim 6, wherein, in the step (d), said Host is selectively assigned from said players for two continuous rounds of game, and then another one of said players must be selected as said Host for next two continuous rounds of game.

8. The method, as recited in claim 5, wherein said deck of cards includes 40 cards, and wherein each deck of cards includes four sets of face value cards and four set of numerical value cards, wherein each set of face cards includes an Ace card, a Jack card, a Queen card, and a King card, and each set of numerical value cards includes a 2 card, a 3 card, a 4 card, a 5 card, 6 card, and a 7 card, a numerical value of each said numerical value cards counting as a point value thereof, said Ace card counting as a point value of "1", and a numerical value of said Jack card, Queen card, and King card counting as a point value of "0".

9. The method, as recited in claim 8, wherein, in the step (d), said Host is selectively assigned from said players for two continuous rounds of game, and then another one of said players must be selected as said Host for next two continuous rounds of game.

10. The method, as recited in claim 3, wherein two cards of said deck are dealt to said BANKER position and another two cards of said deck are dealt to said PLAYER position, wherein said total sum of points for each of said BANKER cards and said PLAYER cards must be lesser than or equal to twenty-one.

11. The method, as recited in claim 10, wherein said deck of cards includes 52 cards, and wherein each deck of cards includes four sets of face value cards and four set of numerical value cards, wherein each set of said face cards includes an Ace card, a Jack card, a Queen card, and a King card, and each set of numerical value cards includes a 2 card, a 3 card, a 4 card, a 5 card, a 6 card, 7 card, 8 card, and 9 card, a numerical value of each said numerical value cards counting as a point value thereof, said Ace card counting as a point value of "1" or "11", and a numerical value of said Jack card, Queen card, and King card counting as a point value of "10".

12. The method, as recited in claim 10, wherein the step (g) further comprises the steps of:

(g.1) dealing at least an additional first hitting card, having a point value, from said deck of cards to said PLAYER position until said total value of said PLAYER cards is equal to or above sixteen, and then summing up said total value of said PLAYER cards and said point value of said first hitting card to form said comparison point for said PLAYER cards; and (i.2) dealing at least an additional second hitting card, having a point value, from said deck of cards to said BANKER position when said total value of said BANKER cards is equal to or above sixteen, and then summing up said total value of said BANKER cards and said point value of said second hitting card to form said comparison point for said BANKER cards.

13. The method, as recited in claim 12, wherein, in step (d), said Host is selectively assigned from said players for two continuous rounds of game, and then another one of said players must be selected as said Host for next two continuous rounds of game.

14. A method of playing a Super Baccarat card game, which comprises the steps of:

(a) providing at least two players for said card game;

(b) providing a BANKER box, a PLAYER box, and a TIE box for each of said players;

(c) providing at least a deck of 36 cards, wherein each deck of cards comprises four sets of face value cards and four set of numerical value cards, wherein each set of said face cards includes an Ace card, a Jack card, a Queen card, and a King card, and each set of numerical value cards includes a 2 card, a 3 card, a 4 card, a 5 card, and a 6 card, a numerical value of each said numerical value cards counting as a point value thereof, said Ace card counting as a point value of "1", and a numerical value of said Jack card, Queen card, and King card counting as a point value of "0";

(d) selecting a Host from said players;

(e) investing a Capital by said Host and an Investment by each of said players other than said Host at said respective BANKER box, PLAYER box, or TIE box;

(f) shuffling said deck of cards;

(g) dealing three cards of said deck of cards to a BANKER position serving as three BANKER cards and dealing another three cards of said deck of cards to a PLAYER position serving as three PLAYER cards;

(h) determining total values of said BANKER cards and said PLAYER cards respectively by summing up points of each of said two BANKER cards and said two PLAYER cards respectively to form a total sum of points;

(i) determining a comparison point value for each of said BANKER cards and said PLAYER cards based on said total point values of said BANKER cards and said P LAYER cards, wherein said comparison value for each of said BANKER cards and said PLAYER cards is counted as a last digit of said total sum of points of each of said BANKER cards and PLAYER cards when said total sum of points is more than nine;

(j) comparing said comparison point values of said BANKER cards at said BANKER position and said PLAYER cards at said PLAYER position, wherein whichever said BANKER cards or said PLAYER cards has a higher comparison point wins said round of game, wherein when said comparison point value of said BANKER cards equals to said comparison point value of said PLAYER cards, said round of game is tie;

(k) determining which of said players is a first action player to play against said Host by (k.1) determining an action number, which is said higher comparison point value of said two comparison point values of said BANKER cards and said PLAYER cards, and (k.2) determining said first action player by counting said action number among said players starting at said Host;

(l) determining whether each of said players wins against said Host in said round of game, starting from said action player, by checking whether said players invested in said BANKER boxes or PLAYER boxes in front of said players, wherein when said BANKER cards at said BANKER position win said round of game over said PLAYER cards at said PLAYER position, each of said players who invested in said respective BANKER box wins against said Host in said round of game, wherein when said PLAYER cards at said PLAYER position win said round of game over said BANKER cards at said BANKER position, each of said players who invested in said respective PLAYER box wins against said Host in said round of game, wherein when said PLAYER cards at said PLAYER position tie said round of game with said BANKER cards at said BANKER position, each of said players who invested in said respective TIE box wins against said Host in said round of game;

(m) starting from said first action player, collecting said Investment of each of said players who loses against said Host in said round of game; and (n) starting from said first action player, paying to each of said players who wins against said Host in said round of game until said Capital is totally paid out, wherein when said Capital, starting from said first action player, is totally paid out for some of said players who win against said Host in said round of game, the rest of said players who win against said Host in said round of game are neither gain nor lose said investments thereof even though the rest of said players have lost said round of game.

15. The method, as recited in claim 14, wherein, in the step (h), when said total value of either said BANKER cards or said PLAYER cards equals to 8 or 9, said total point value is counted as Natural comparison point and said BANKER cards or said PLAYER cards wins said round of game.

16. The method, as recited in claim 15, wherein said deck of cards further includes at least a Joker card and each set of numerical value cards further includes a 7 card, wherein said Joker cards acts as a wild card that selectively represents a point value from 0 to 9 in such a manner that when a hand of each of said BANKER cards and said PLAYER cards consists of said Joker card, said total point value of said hand of said BANKER cards or said PLAYER cards counts as a natural comparison point value of "9" which is greater than said comparison point value "9" without said joker card.

17. The method, as recited in claim 16, in the step (b) further providing a Side Bet boxes wherein each of said Side bet boxes represents at least a predetermined point value and wherein, in the step (l), further comprises a step of determining whether each of said players wins against said Host in said round of game, starting from said action player, by checking whether said players invested in said respective Side Bet boxes, wherein when said higher comparison point value of said round of game matches said point value in said respective Side Bet box in said round of game, each of said players who invested in said respective Side Bet box wins said round of game over said Host.

18. The method, as recited in claim 17, Wherein said Side Bet boxes includes an ODD box, an EVEN box, an ABOVE box, a BELOW box, and a plurality of POINT VALUE boxes, said ODD box representing point value of "1", "3", "5", "7", and "9", said EVEN box representing point values of "0", "2", "4", "6", and "8", said BELOW box representing point values of "0", "1 ", "2", "3", and "4", said ABOVE box representing point values of "5", "6", "7", "8", and "9" and said POINT VALUE boxes representing point values of "0", "1", "2", "3", "4", "5", "6", "7", "8", and "9" respectively.

19. The method, as recited in claim 15, wherein said deck of cards further includes at least a Joker card and each set of numerical value cards further includes a 7 card, wherein said Joker cards acts as a wild card that selectively represents a point value either 1 or 7 in such a manner that when a hand of each of said BANKER cards and said PLAYER cards consists of said Joker card, said total point value of said hand of said BANKER cards or said PLAYER cards counts by summing up said point value of said Joker card and said point value of another two said BANKER cards or said PLAYER cards.

20. The method, as recited in claim 19, in the step (b) further providing a Side Bet boxes wherein each of said Side bet boxes represents at least a predetermined point value and wherein, in the step (l), further comprises a step of determining whether each of said players wins against said Host in said round of game, starting from said action player, by checking whether said players invested in said respective Side Bet boxes, wherein when said higher comparison point value of said round of game matches said point value in said respective Side Bet box in said round of game, each of said players who invested in said respective Side Bet box wins said round of game over said Host.

21. The method, as recited in claim 20, wherein said Side Bet boxes includes an ODD box, an EVEN box, an ABOVE box, a BELOW box, and a plurality of POINT VALUE boxes, said ODD box representing point value of "1", "3", "5", "7", and "9", said EVEN box representing point values of "0", "2", "4", "6", and "8", said BELOW box representing point values of "0", "1", "2", "3", and "4", said ABOVE box representing point values of "5", "6", "7", "8", and "9" and said POINT VALUE boxes representing point values of "0", "1", "2", "3", "4", "5", "6", "7", "8", and "9" respectively.

22. The method, as recited in claim 15, in the step (b) further providing a Side Bet boxes wherein each of said Side bet boxes represents at least a predetermined point value and wherein, in the step (l), further comprises a step of determining whether each of said players wins against said Host in said round of game, starting from said action player, by checking whether said players invested in said respective Side Bet boxes, wherein when said higher comparison point value of said round of game matches said point value in said respective Side Bet box in said round of game, each of said players who invested in said respective Side Bet box wins said round of game over said Host.

23. The method, as recited in claim 22, wherein said Side Bet boxes includes an ODD box, an EVEN box, an ABOVE box, a BELOW box, and a plurality of POINT VALUE boxes, said ODD box representing point value of "1", "3", "5", "7", and "9", said EVEN box representing point values of "0", "2", "4", "6", and "8", said BELOW box representing point values of "0", "1", "2", "3", and "4", said ABOVE box representing point values of "5", "6", "7", "8", and "9" and said POINT VALUE boxes representing point values of "0", "1 ", "2", "3", "4", "5", "6", "7", "8", and "9" respectively.

24. A method of playing a Super Baccarat card game, which comprises the steps of:

(a) providing at least two players for said card game;

(b) providing a BANKER box, a PLAYER box, and a TIE box for each of said players;

(c) providing at least a deck of 52 cards, wherein each deck of cards includes four sets of face value cards and four sets of numerical value cards, wherein each set of said face cards includes an Ace, a Jack card, a Queen card, and a King card and each of said numerical value cards includes a 2 card, a 3 card, a 4 card, a 5 card, a 6 card, a 7 card, a 8 card, a 9 card, and a 10 card, a numerical value of each said numerical value cards counting as a point value thereof, said Ace card counting as a point value of either "1" or "11", said Jack card, said Queen card, and said King card respectively counting as a value of "10";

(d) selecting a Host from said players;

(e) investing a Capital by said Host and an Investment by each of said players other than said Host at said respective BANKER box, PLAYER box, or TIE box;

(f) shuffling said deck of cards;

(g) dealing two cards of said deck of cards to a BANKER position serving as two BANKER cards and dealing another two cards of said deck of cards to a PLAYER position serving as two PLAYER cards;

(h) determining total values of said BANKER cards and said PLAYER cards respectively by summing up points of each of said two BANKER cards and said two PLAYER cards respectively to form a total sum of points;

(i) determining a comparison point value for each of said BANKER cards and said PLAYER cards based on said total point values of said BANKER cards and said PLAYER cards wherein said total point values of said BANKER cards and said PLAYER cards must be equal to or less than twenty-one such that when said total value of said BANKER cards or said PLAYER cards over a limit of twenty-one, said BANKER position or said PLAYER position losses said round of game;

(j) comparing said comparison point values of said BANKER cards at said BANKER position and said PLAYER cards at said PLAYER position, wherein whichever said BANKER cards or said PLAYER cards has a higher comparison point wins said round of game, wherein when said comparison point value of said BANKER cards equals to said comparison point value of said PLAYER cards, said round of game is tie;

(k) determining which of said players is a first action player to play against said Host by (k.1) determining an action number, which is said higher comparison point value of said two comparison point values of said BANKER cards and said PLAYER cards, and (k.2) determining said first action player by counting said action number among said players starting at said Host;

(l) determining whether each of said players wins against said Host in said round of game, starting from said action player, by checking whether said players invested in said BANKER boxes or PLAYER boxes in front of said players, wherein when said BANKER cards at said BANKER position win said round of game over said PLAYER cards at said PLAYER position, each of said players who invested in said respective BANKER box wins against said Host in said round of game, wherein when said PLAYER cards at said PLAYER position win said round of game over said BANKER cards at said BANKER position, each of said players who invested in said respective PLAYER box wins against said Host in said round of game, wherein when said PLAYER cards at said PLAYER position tie said round of game with said BANKER cards at said BANKER position, each of said players who invested in said respective TIE box wins against said Host in said round of game;

(m) starting from said first action player, collecting said Investment of each of said players who loses against said Host in said round of game; and (n) starting from said first action player, paying to each of said players who wins against said Host in said round of game until said Capital is totally paid outs wherein when said Capital, starting from said first action player, is totally paid out for some of said players who win against said Host in said round of game, the rest of said players who win against said Host in said round of game are neither gain nor lose said investments thereof even though the rest of said players have lost said round of game.

25. The method, as recited in claim 24, wherein the step (h) further comprises the steps of:

(h.1) dealing at least an additional first hitting card, having a point value, from said deck of cards to said PLAYER position until said total value of said PLAYER cards is equal to or above sixteen, and then summing up said total value of said PLAYER cards and said point value of said first hitting card to form said comparison point for said PLAYER cards; and (h.2) dealing at least an additional second hitting card, having a point value, from said deck of cards to said BANKER position when said total value of said BANKER cards is equal to or above sixteen, and then summing up said total value of said BANKER cards and said point value of said second hitting card to form said comparison point for said BANKER cards.

26. The method, as recited in claim 25, in the step (b) further providing a Side Bet boxes wherein each of said Side bet boxes represents at least a predetermined point value and wherein, in step (l), further comprises a step of determining whether each of said players wins against said Host in said round of game, starting from said action player, by checking whether said players invested in said respective Side Bet boxes, wherein when said higher comparison point value of said round of game matches said point value in said respective Side Bet box in said round of game, each of said players who invested in said respective Side Bet box wins said round of game over said Host.

27. The method, as recited in claim 26, wherein said Side Bet boxes includes an ODD box, an EVEN box, an ABOVE box, a BELOW box, and a plurality of POINT VALUE boxes, said ODD box representing point value of "19" and "21", said EVEN box representing point values of "18" and "20", said BELOW box representing point values of "18" and "19", said ABOVE box representing point values of "20", and "21", and said POINT VALUE boxes representing point values of "17", "18", "19", "20", and "21" respectively.

* * * * *